US011134772B1

(12) United States Patent
Brunner

(10) Patent No.: US 11,134,772 B1
(45) Date of Patent: Oct. 5, 2021

(54) SUPPORT ASSEMBLY FOR TABLE SYSTEM AND CORRESPONDING METHOD

(71) Applicant: The Boeing Company, Chicago, IL (US)

(72) Inventor: Jordan R. Brunner, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/930,542

(22) Filed: May 13, 2020

(51) Int. Cl.
*A47B 5/04* (2006.01)

(52) U.S. Cl.
CPC ..... *A47B 5/04* (2013.01)

(58) Field of Classification Search
CPC ..... A47B 5/00; A47B 5/04; A47B 31/06
USPC ..... 108/42, 46, 108, 152; 297/147, 146
See application file for complete search history.

(56) References Cited

U.S. PATENT DOCUMENTS 1,059,144 A * 4/1913 Gillespie ..... A47B 5/04 108/37
1,753,423 A * 4/1930 Kroschel ..... A47B 5/04 108/37
1,796,002 A * 3/1931 Covell ..... A47B 5/04 108/37
1,849,446 A * 3/1932 Bartlett ..... A47B 5/04 108/38
2,098,426 A * 11/1937 McDonald ..... B60N 3/004 297/146
2,577,399 A * 12/1951 Bell ..... A47B 5/04 248/240.4
2,635,678 A * 4/1953 Basil ..... B61D 33/00 297/146
2,760,836 A * 8/1956 Fangman ..... A47B 5/04 108/38
2,963,078 A * 12/1960 Ferrelle ..... B60N 3/004 297/146
3,730,107 A * 5/1973 Bergkamp ..... A47B 5/04 108/39
3,742,868 A * 7/1973 Garceau ..... A47B 77/10 108/39
4,068,601 A * 1/1978 Marsh ..... A47B 5/04 108/134
4,474,406 A * 10/1984 Wall ..... B62D 47/02 16/374

(Continued)

FOREIGN PATENT DOCUMENTS

CA 2800414 A1 * 6/2013 ..... A47B 5/06

*Primary Examiner* — Jose V Chen
(74) *Attorney, Agent, or Firm* — Quinn IP Law

(57) ABSTRACT

A support assembly for a table being mounted on a first wall includes a frame configured to be at least partially inserted in a cavity defined in a second wall. The table is movable between a stowed position and a deployed position. The support assembly includes at least one support arm rotatably coupled to the frame and movable through a plurality of positions between a retracted position and an extended position. A biasing member is operatively connected to the frame and configured to bias the support arm toward the retracted position, wherein the at least one support arm is configured to move from the retracted position to the extended position as the table moves from the stowed position to the deployed position. A method for assembling a table system and a table system having the support assembly are provided.

21 Claims, 5 Drawing Sheets

(56) References Cited

U.S. PATENT DOCUMENTS

| | | | | |
|---|---|---|---|---|
| 4,909,158 | A * | 3/1990 | Sorensen | A47B 77/10 108/40 |
| 5,081,724 | A * | 1/1992 | Takahashi | A47D 5/003 108/38 |
| 8,381,661 | B2 * | 2/2013 | Hilde | A47B 43/00 108/42 |
| 8,434,415 | B1 * | 5/2013 | Federici | A47C 7/62 108/42 |
| 2013/0098276 | A1 * | 4/2013 | Trinko | A47C 17/46 108/33 |
| 2020/0237092 | A1 * | 7/2020 | Paindavoine | A47B 3/04 |

* cited by examiner

SUPPORT ASSEMBLY FOR TABLE SYSTEM AND CORRESPONDING METHOD

TECHNICAL FIELD

The disclosure relates generally to a support assembly, a table system with the support assembly and method of assembling a table system.

BACKGROUND

Tables are employed for a multitude of functions, providing a surface for the placement of objects for various purposes, such as eating, writing, drawing, and playing games. Another use of tables is for providing a surface for placing and changing an infant. Tables are often provided in lavatories in passenger trains, passenger ships, and passenger aircraft for changing a baby's diaper. The table must be supported and sufficiently robust for a high number of cycles and load, while also maximizing the lavatory space for all other activities. In other words, space is often a limiting factor.

SUMMARY

Disclosed herein is a support assembly for a table configured to be mounted on a first wall, the table being movable between a stowed position and a deployed position. The support assembly includes a frame configured to be at least partially inserted in a cavity defined in a second wall. At least one support arm is rotatably coupled to the frame and movable through a plurality of positions between a retracted position and an extended position. A biasing member is operatively connected to the frame and configured to bias the at least one support arm toward the retracted position, wherein the at least one support arm is configured to move from the retracted position to the extended position as the table moves from the stowed position to the deployed position.

The support assembly may include a keyed shaft operatively connected to the biasing member, with the at least one support arm including a keyed bore configured to mate with the keyed shaft. The frame includes a plurality of sidewalls having respective holes. The keyed shaft is threaded through the respective holes and the keyed bore to support the plurality of positions of the at least one support arm. A bearing may be positioned in at least one of the respective holes and the keyed bore.

The second wall has an outer surface facing a user of the table. The biasing member may be positioned behind the outer surface of the second wall. The at least one support arm includes a curved surface configured to intersect a first table surface of the table as the table moves in a first direction from a stowed position towards a deployed position. The curved surface includes a first arched surface and a second arched surface. The second arched surface includes a respective curvature opposed to the first arched surface.

The at least one support arm includes an inclined surface configured to allow the at least one support arm to be pushed towards the extended position as the table moves towards the deployed position. The at least one support arm includes a base surface defining a reference angle with respect to a reference plane, the reference plane being substantially orthogonal to the second wall. The reference angle is 0° when the at least one support arm is in the extended position and the reference angle is greater than 45° when the at least one support arm is in the retracted position.

A portion of the at least one support arm protrudes from the frame when the at least one support arm is in the retracted position. The frame may include a recessed portion, the recessed portion being divided into a first recessed portion and a second recessed portion. The first recessed portion has a first depth and the second recessed portion has a second depth, the first depth being different from the second depth. The at least one support arm is at least partially positioned in the second recessed portion. The first recessed portion includes at least one aperture for coupling the frame to the second wall. The frame includes a shelf portion contiguous with and positioned between the first recessed portion and the second recessed portion. The shelf portion is angled and configured to at least partially transfer a load from the at least one support arm to the frame.

A table system includes a table configured to be mounted on a first wall and support assembly for supporting the table. The table has a first table surface and is moveable between a stowed position and a deployed position. The support assembly includes at least one support arm and a frame configured to be at least partially inserted in a cavity in a second wall. The at least one support arm is rotatably coupled to the frame. The at least one support arm is movable through a plurality of positions between a retracted position and an extended position and includes a curved surface. A biasing member is operatively connected to the frame and configured to bias the at least one support arm toward the retracted position.

The at least one support arm is configured to move from the retracted position to the extended position via the first table surface contacting the curved surface of the at least one support arm as the table moves from the stowed position to the deployed position. The at least one support arm is configured to automatically retract from the extended position to the retracted position when the table moves from the deployed position to the stowed position. The second wall has an outer surface facing a user of the table system, with the biasing member being positioned behind the outer surface of the second wall.

A method for assembling a table system includes mounting an edge of the table on a first wall such that the table is moveable between a stowed position and a deployed position, the table having a first table surface. The method includes inserting the frame at least partially into a cavity defined in a second wall. At least one support arm is coupled to the frame such that the at least one support arm is movable through a plurality of positions between a retracted position and an extended position. The method includes biasing the at least one support arm toward the retracted position, via a biasing member operatively connected to the frame. The frame is positioned relative to the table such that the at least one support arm moves from the retracted position to the extended position via the first table surface contacting a first arched surface of the at least one support arm as the table moves from the stowed position to the deployed position.

Coupling the at least one support arm to the frame may further include threading a keyed shaft through respective holes in a plurality of sidewalls in the frame and mating the keyed shaft with a keyed bore in the at least one support arm. Biasing the at least one support arm may further include coupling the keyed shaft to the biasing member to enable movement of the at least one support arm through the plurality of positions and biasing of the at least one support arm toward the retracted position.

Coupling the at least one support arm to the frame may further include positioning the at least one support arm relative to the frame such that a base surface of the at least one support arm defines a reference angle with respect to a reference plane substantially orthogonal to the first wall. The method may include positioning the at least one support arm such that the reference angle is 0° when the at least one support arm is in the extended position and the reference angle is greater than 45° when the at least one support arm is in the retracted position.

Coupling the at least one support arm to the frame may further include positioning a seated portion of the at least one support arm in a second recessed portion of the frame, the first recessed portion having a first depth. The frame includes a second recessed portion having a second depth different from the first depth. The method may include coupling the frame to the second wall by positioning at least one fastener in at least one aperture in the first recessed portion.

The above features and advantages and other features and advantages of the present disclosure are readily apparent from the following detailed description of the best modes for carrying out the disclosure when taken in connection with the accompanying drawings.

DETAILED DESCRIPTION

Figure 1:
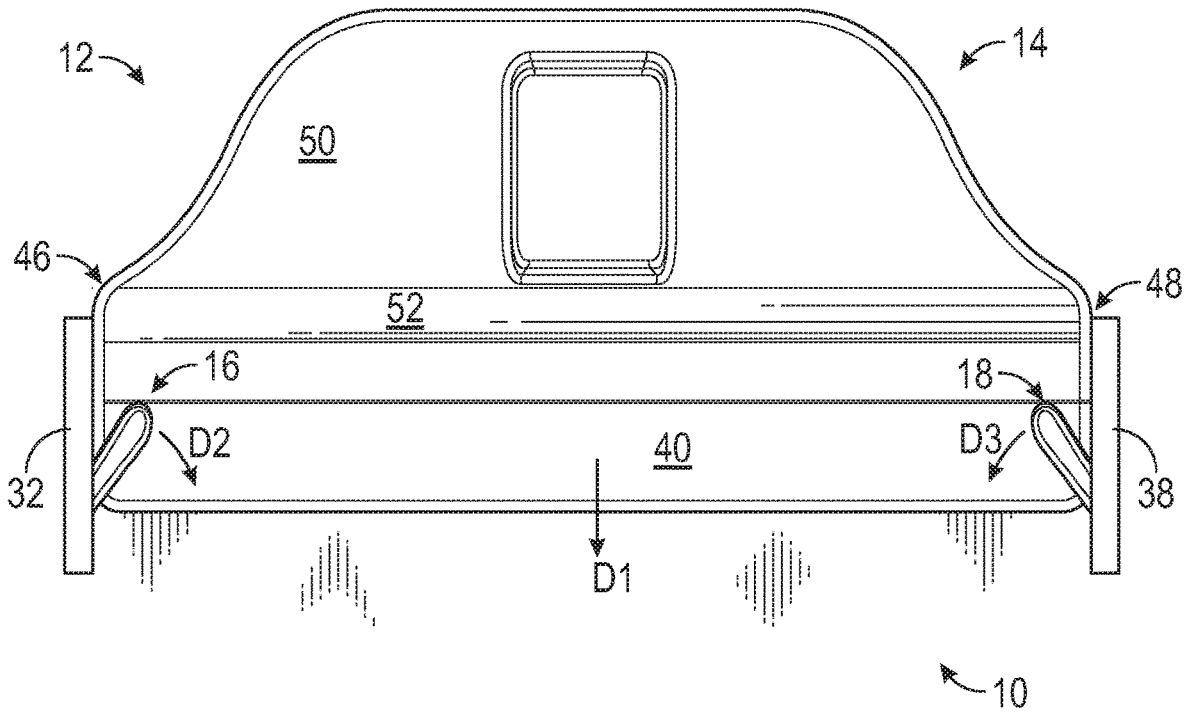
FIG. 1 is a schematic perspective view of a support assembly, which may be part of a table system.

Referring to the drawings, wherein like reference numbers refer to like components, FIG. 1 schematically illustrates a support assembly 10, which may be a component of a table system 12. The support assembly 10 may be employed to support a structure 14, referred to herein as table 14. It is to be understood that the term "table" includes any structure or slab-like piece that provides a surface. Referring to FIG. 1, the support assembly 10 includes at least one support arm 16 ("at least one" omitted henceforth). In the embodiment shown, the support assembly 10 includes a second support arm 18. The number of support arms may be varied based on the application at hand.

Figure 2:
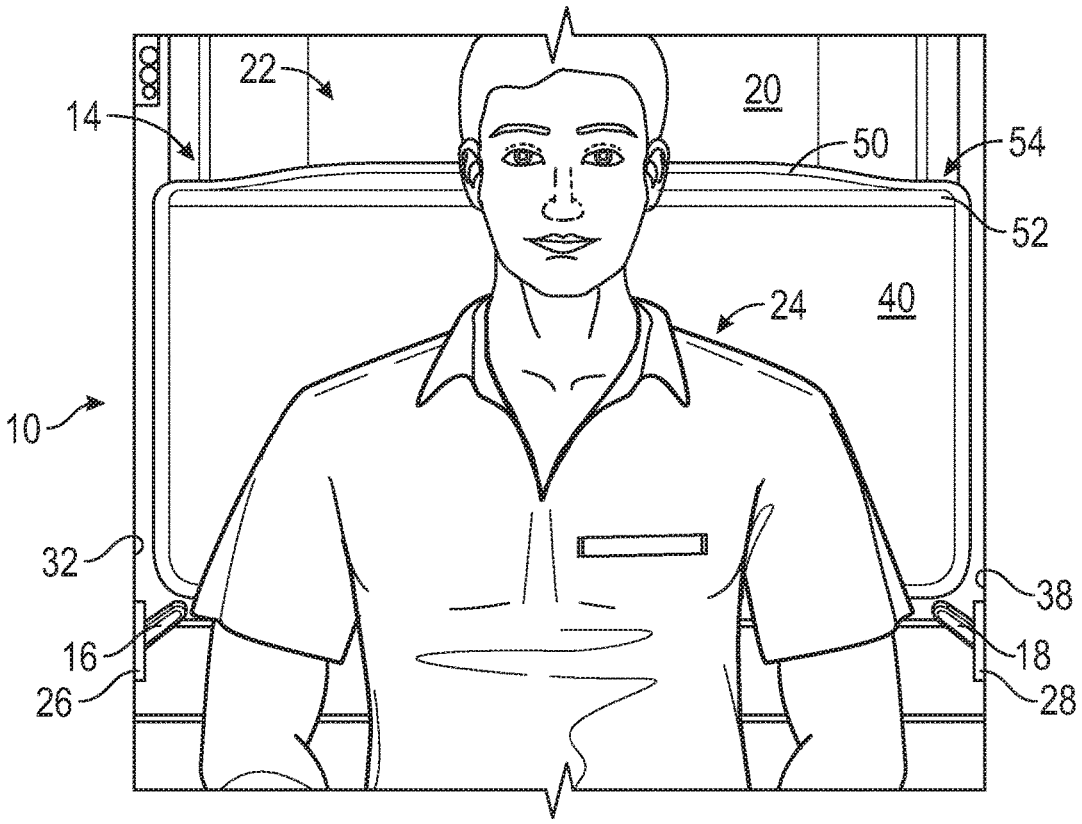
FIG. 2 is a schematic fragmentary end view of the support assembly of FIG. 1.

Referring to FIG. 1, the table 14 is mounted on a first wall 20 of a cabin 22. In one example, the cabin 22 is a lavatory. Some lavatories utilize countertop space for supporting an infant changing table. The support assembly 10 eliminates the need for extra countertop space for supporting the table 14. FIG. 2 is a schematic fragmentary end view of the support assembly 10, shown with a user 24 in the cabin 22. Some lavatories utilize brackets (not shown) with lateral protrusions to support an infant changing table. The brackets take up lateral space and may encumber an occupant as they maneuver within the lavatory, particularly when the occupant is at a seated position on a toilet. Referring to FIG. 2, the support assembly 10 provides a simple and robust solution that minimizes the amount of lateral space taken up, thus providing greater lateral room for the user 24.

Figure 3:
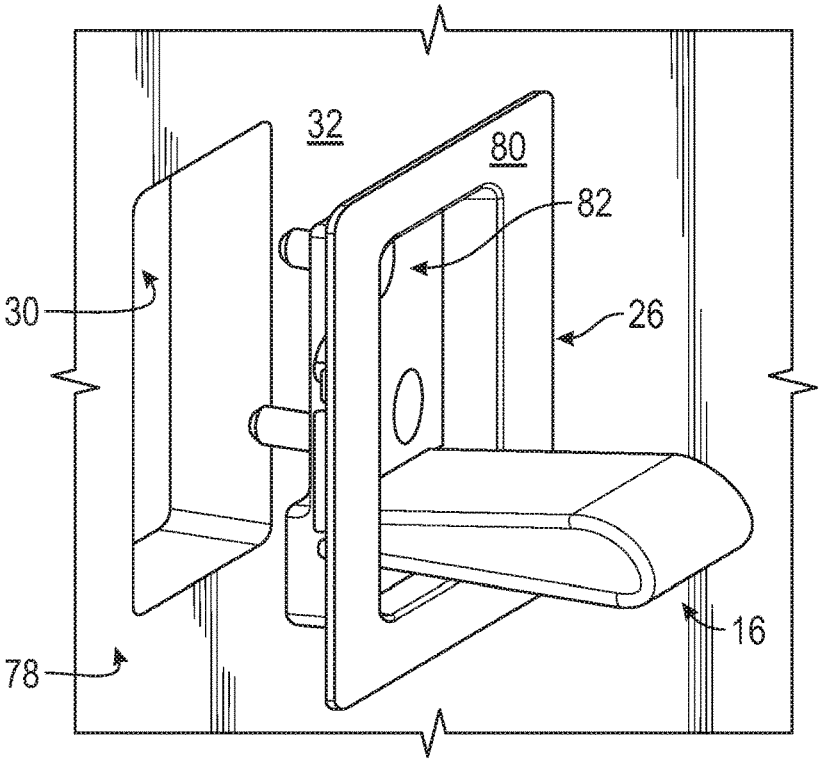
FIG. 3 is a schematic perspective view of a portion of the support assembly being inserted into a cavity.
Figure 4:
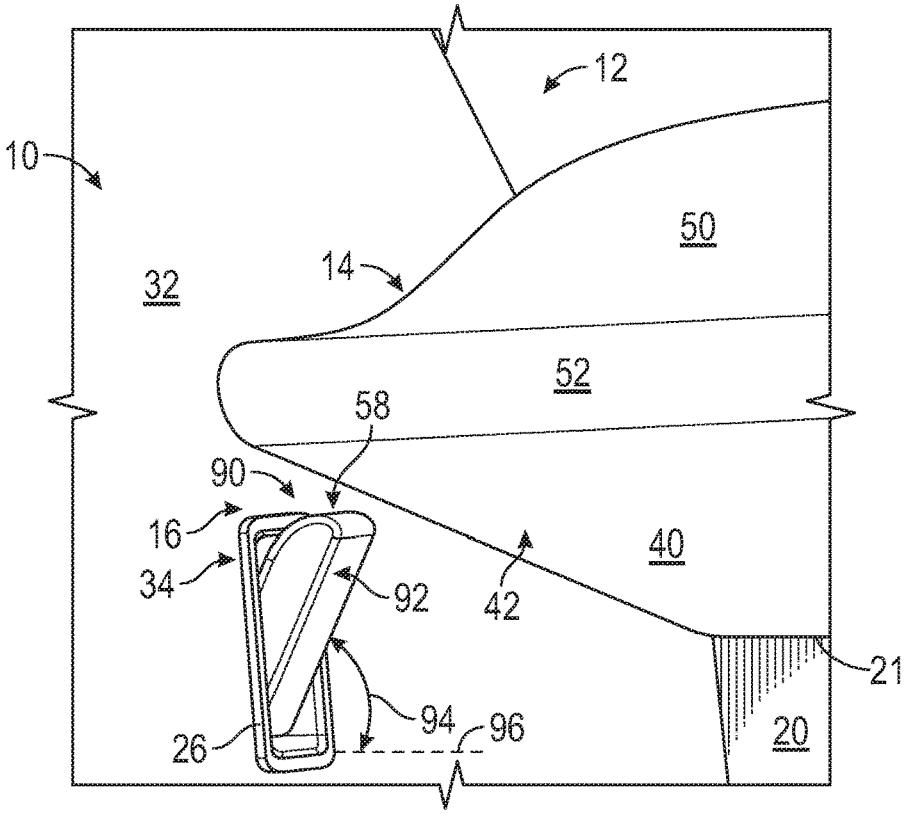
FIG. 4 is a schematic fragmentary perspective close-up view of a support arm in the support assembly, the support arm being in a retracted position.

Referring to FIGS. 1-2, the support arm 16 is rotatably coupled to a frame 26 and operatively connected to a second wall 32 in the cabin 22. As shown in FIG. 3, the frame 26 is configured to be at least partially inserted in a cavity 30 defined in the second wall 32 of the cabin 22. Referring to FIG. 3, the frame 26 may include a rim portion 80 surrounding a recessed portion 82. When the frame 26 is positioned in the cavity, the recessed portion 82 sits in the cavity 30, while the rim portion 80 abuts against an outer surface 78 of the second wall 32, as shown in FIG. 3. The support arm 16 is movable through a plurality of positions, between a retracted position 34 and an extended position 36. FIG. 4 shows a close-up view of the support arm 16 in the retracted position 34, while FIG. 5 shows a close-up view of the support arm 16 in the extended position 36.

Referring to FIG. 2, the second support arm 18 rotatably coupled to a frame 28 and operatively connected to a third wall 38. The second support arm 18 is similar to the support arm 16. For brevity, a detailed description of the second support arm 18 is omitted. Referring to FIGS. 1-2 and 4-5, the table 14 may include a planar portion 40 defining a first table surface 42. The table 14 extends between a first end 46 and a second end 48, shown in FIG. 1. Referring to FIGS. 1-2 and 4-5, the table 14 may include a handle portion 50 that is angled relative to the planar portion 40. The handle portion 50 and the planar portion 40 are separated by a transition portion 52. The handle portion 50 may be used to assist a user 24 in moving the table 14. In one example, the handle portion 50 is substantially orthogonal to the planar portion.

Figure 5:
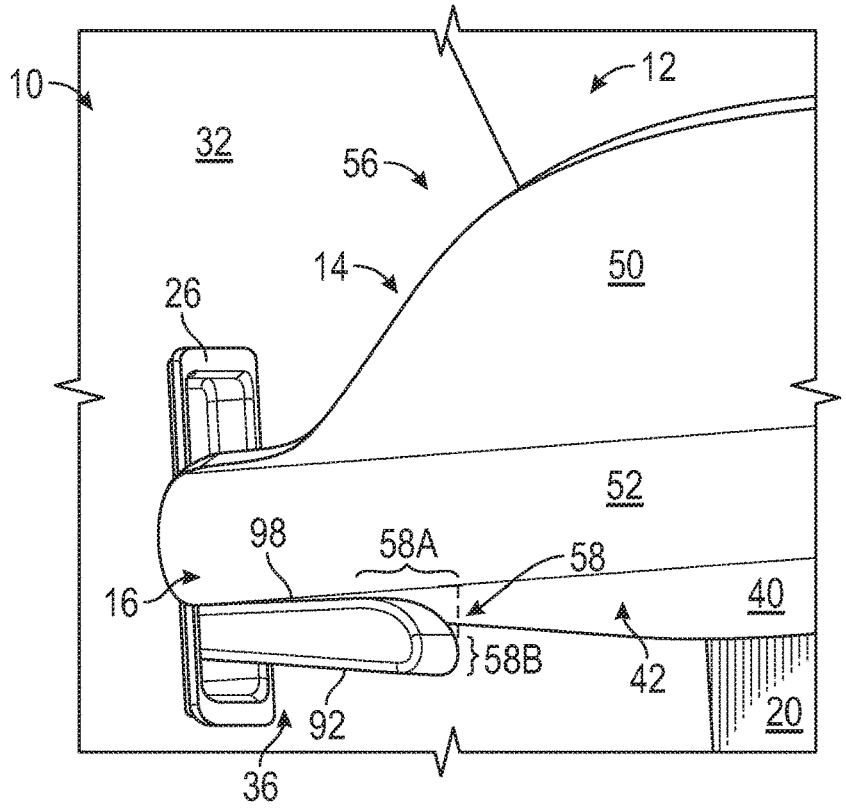
FIG. 5 is a schematic fragmentary perspective close-up view of the support arm of FIG. 4, in an extended position.

The table 14 is movable in a first direction D1 (shown in FIG. 1) from a stowed position 54 (shown in FIG. 2) towards a deployed position 56 (shown in FIG. 5). The support arm 16 is configured to move in a second direction D2 (shown in FIG. 1) from the retracted position 34 (shown in FIG. 4) to the extended position 36 (shown in FIG. 5). Referring to FIG. 1, the second support arm 18 may move in a direction D3. As described below, the support arm 16 is configured to move from the retracted position 34 to the extended position 36 via the first table surface 42 contacting a curved surface 58 (see FIG. 4) of the support arm 16 as the table 14 moves from the stowed position 54 to the deployed position 56.

Figure 6:
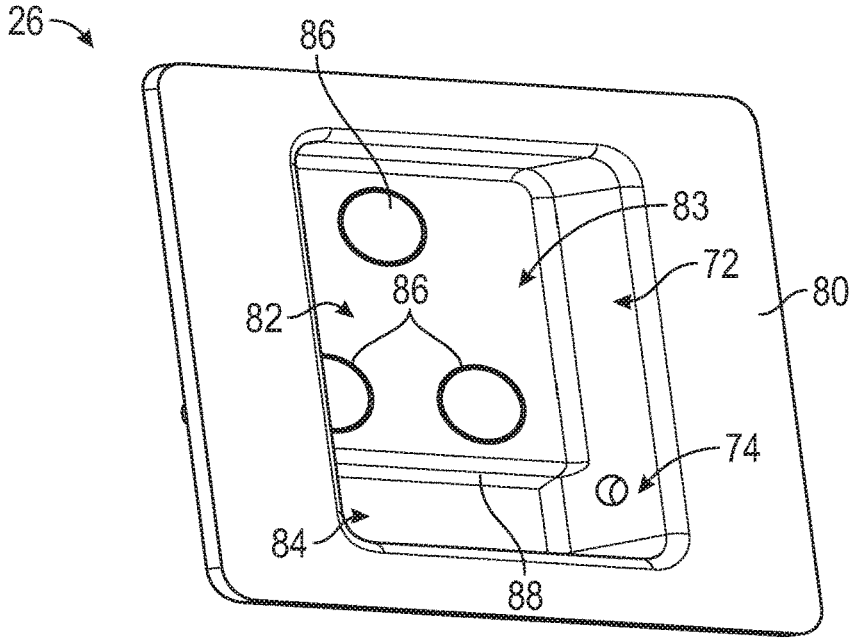
FIG. 6 is a schematic perspective view of a frame that may be employed in the support assembly of FIG. 1.
Figure 7:
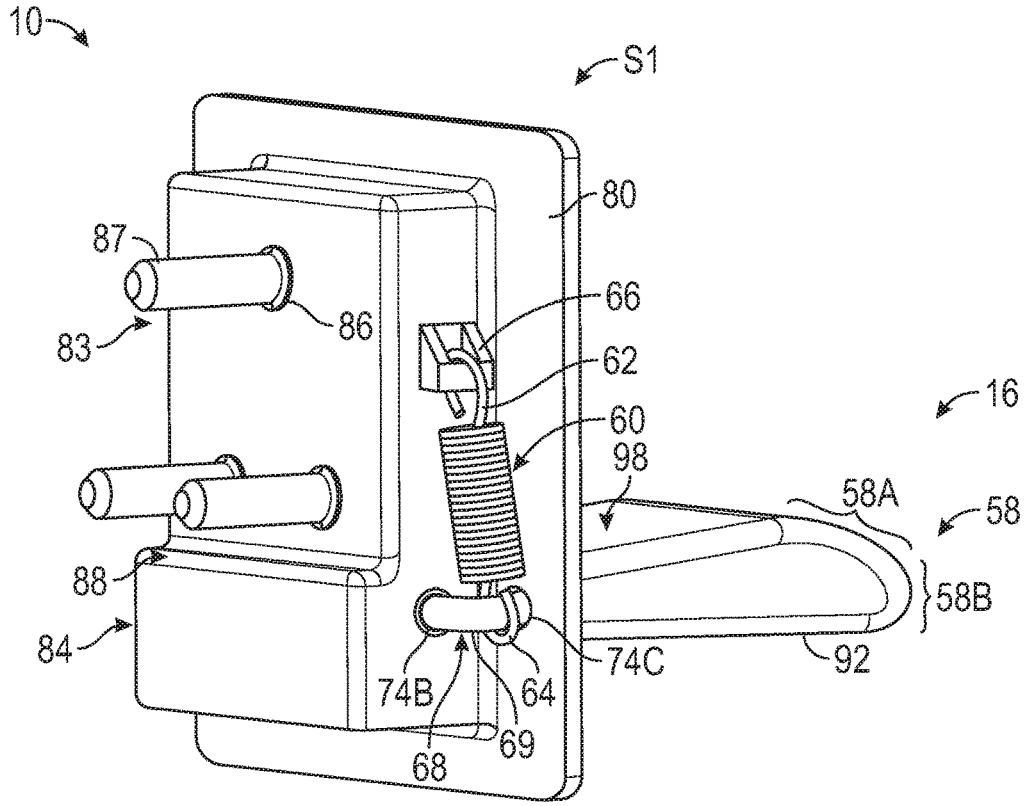
FIG. 7 is a schematic perspective view of the support assembly of FIG. 1, shown from a first side.
Figure 8:
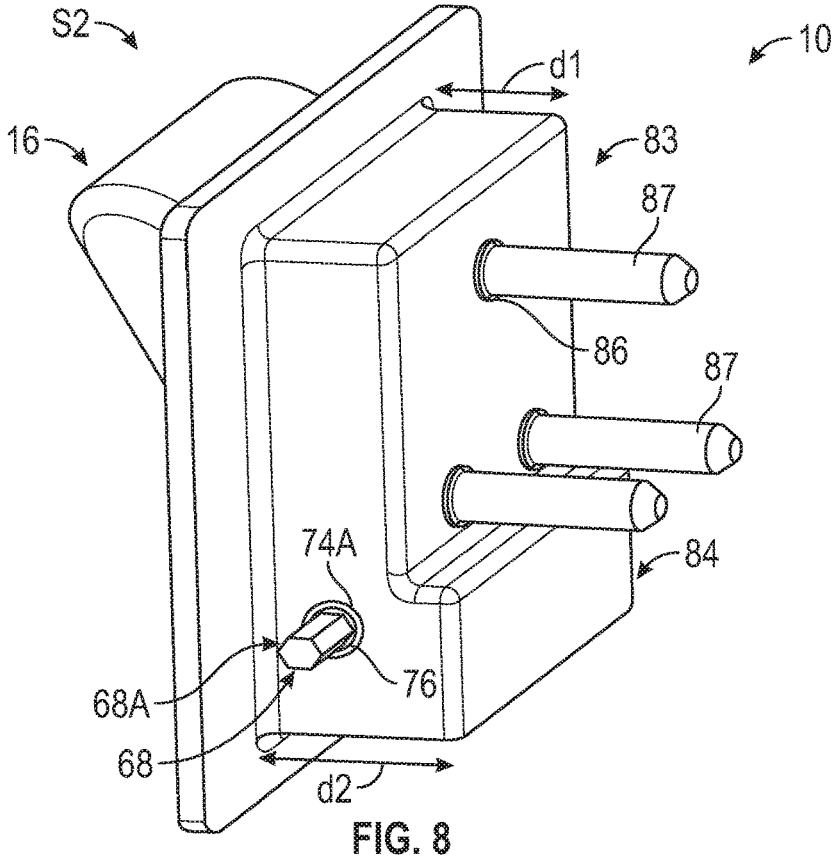
FIG. 8 is a schematic perspective view of the support assembly of FIG. 1, shown from a second side.

FIG. 6 is a schematic perspective view of an example frame 26 that may be employed in the support assembly 10 of FIGS. 1-2. Referring now to FIGS. 7-8, a schematic perspective view of the support assembly 10 is shown from a first side 51 and a second side S2, respectively. Referring to FIG. 7, a biasing member 60 is configured to bias the support arm 16 in the retracted position 34 (shown in FIG. 4). The biasing member 60 may include, but is not limited to, a compression spring, a torsion spring, an extension spring and a constant force spring. The biasing member 60 enables the support arm 16 to automatically retract from the extended position 36 to the retracted position 34 when the table 14 moves from the deployed position 56 to the stowed position 54. As shown in FIG. 7, the biasing member 60 includes a first hook 62 and a second hook 64, at opposing ends of the biasing member 60. The biasing member 60 may be operatively connected to the frame 26, via the first hook 62 and a connector 66, shown in FIG. 7. The connector 66 may be attached onto the frame 26. The connector 66 may be integrally formed with the frame 26.

Figure 9:
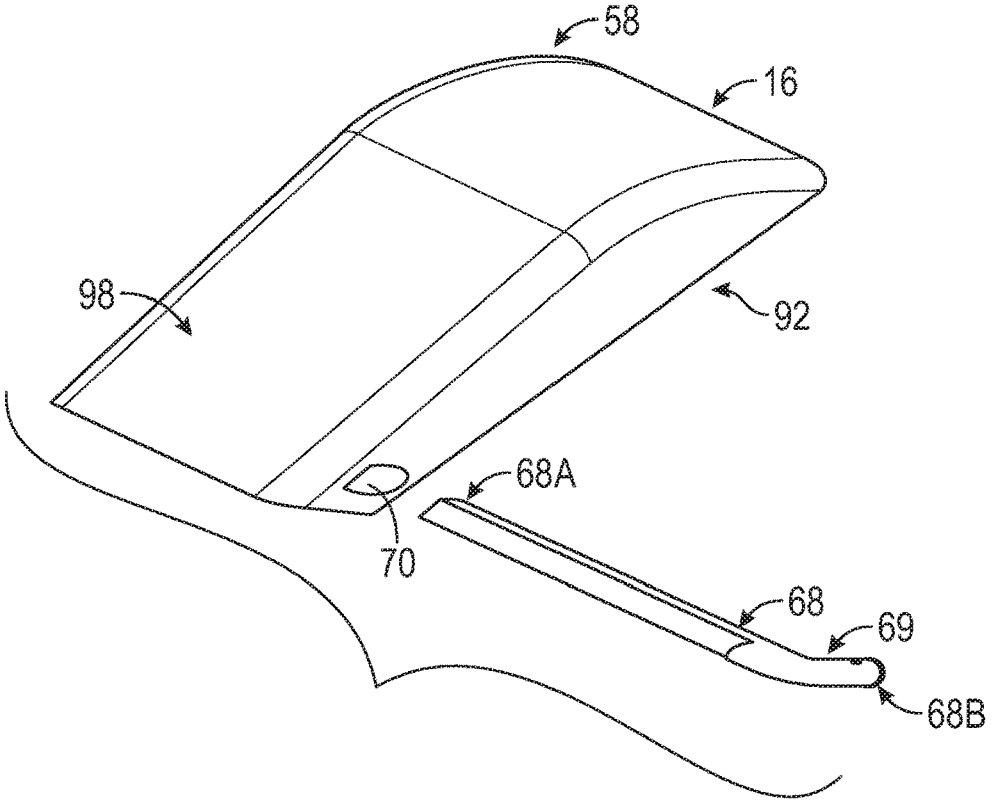
FIG. 9 is a schematic exploded view of the support arm and a keyed shaft that may be employed in the support assembly of FIG. 1.

FIG. 9 is a schematic exploded view of the support arm 16 and a keyed shaft 68 (also shown in FIGS. 7-8) that may be employed in the support assembly 10. The keyed shaft defines a first end 68A and a second end 68B, as shown in FIG. 9. Referring to FIG. 7, the biasing member 60 may be attached to the keyed shaft 68 via the second hook 64. Referring to FIG. 9, the support arm 16 includes a keyed bore 70 configured to mate with the keyed shaft 68. The keyed bore 70 includes corresponding grooves (not shown) to support the keyed shaft 68. The keyed shaft 68 enables the support arm 16 to rotate back and forth.

Referring now to FIG. 6, the frame 26 includes a plurality of sidewalls 72 having respective holes 74. The respective holes 74 may include a first hole 74A (see FIG. 8), a second hole 74B (see FIG. 7) and a third hole 74C (see FIG. 7). Referring to FIGS. 7 and 9, the keyed shaft 68 includes an arcuate portion 69 between two substantially linear portions. The keyed shaft 68 is threaded through the respective holes 74 and the keyed bore 70 to support the plurality of positions of the support arm 16. As shown in FIG. 7, the arcuate portion 69 of the keyed shaft 68 extends between the second hole 74B and the third hole 74C.

Referring to FIG. 8, a bearing 76 may be positioned in at least one of the respective holes and the keyed bore. The bearing 76 is an engineered interface that is designed to allow for relative rotation between the respective holes and the keyed shaft. The bearing 76 may be a bushing, a sleeve made from a low-friction material, a multi-race bearing, or other type of interfacing device available to those skilled in the art.

Referring to FIG. 3, the biasing member 60 is at least partially positioned within the cavity 30 in the second wall 32. The keyed shaft 68 and the respective holes 74 allow the biasing member 60 to be hidden behind the second wall 32. The biasing member 60 may be isolated from the interior of the cabin 22, minimizing tampering of the biasing member 60. For example, the biasing member 60 may be positioned behind an outer surface 78 of the second wall 32, the outer surface 78 facing the user 24 (see FIG. 2).

As noted above, and referring to FIG. 6, the frame 26 may include a rim portion 80 surrounding a recessed portion 82. Referring to FIGS. 7-8, the recessed portion 82 is divided into a first recessed portion 83 and a second recessed portion 84. As shown in FIGS. 7-8, the first recessed portion 83 has a first depth d1 and the second recessed portion 82 has a second depth d2, the first depth d1 being different from the second depth d2. In the example shown, the second depth d2 is greater than the first depth d1. The support arm 16 is at least partially positioned in the second recessed portion 84. The first recessed portion 83 includes at least aperture 86 (shown in FIGS. 6-8) for coupling the frame 26 to the second wall 32. Referring to FIGS. 7-8, at least one fastener 87 may be employed for securing the frame 26 to the second wall 32, via the aperture 86. Referring to FIGS. 6-7, the frame 26 includes a shelf portion 88 contiguous with and positioned between the first recessed portion 83 and the second recessed portion 84. In the example shown, the shelf portion 88 is angled and configured to at least partially transfer a load from the support arm 16 to the frame 26. The keyed shaft 68 is positioned in sufficient proximity to the shelf portion 88 to allow the shelf portion 88 to act as a mechanical load transfer mechanism.

Referring to FIG. 4, the support arm 16 includes a curved surface 58 configured to intersect the first table surface 42 of the table 14 as the table 14 moves in a first direction D1 (see FIG. 1) from a stowed position 54 (see FIG. 1) towards a deployed position 56 (see FIG. 5). Referring to FIG. 5, the curved surface 58 includes a first arched surface 58A, and a second arched surface 58B that is contiguous with the first arched surface 58A. The first arched surface 58A is configured to enable the table 14 to glide along the support arm 16 as the table 14 moves along the first direction D1. As shown in FIG. 5, the second arched surface 58B includes or defines a respective curvature opposed to the first arched surface 58A. The second arched surface 58B is configured to prevent the table 14 from sliding off the support arm 16 as the table 14 moves along the first direction D1. The second arched surface 58B is asymmetric relative to the first arched surface 58A.

Referring to FIG. 4, a portion 90 of the support arm 16 may protrude from the frame 26 when the support arm 16 is in the retracted position 34. The support arm 16 includes a base surface 92 defining a reference angle 94 with respect to a reference plane 96, as shown in FIG. 4. The reference plane 96 is substantially orthogonal to the second wall 32. The reference angle 94 is 0° when the support arm 16 is in the extended position 36 (shown in FIG. 5) and the reference angle 94 is greater than 45° when the support arm 16 is in the retracted position 34 (shown in FIG. 4). Referring to FIGS. 5, 7 and 9, the support arm 16 may include an inclined surface 98 opposed to the base surface 92. The inclined surface 98 is configured to allow the support arm 16 to be pushed towards the extended position 36 as the table 14 moves towards the deployed position 56.

Figure 10:
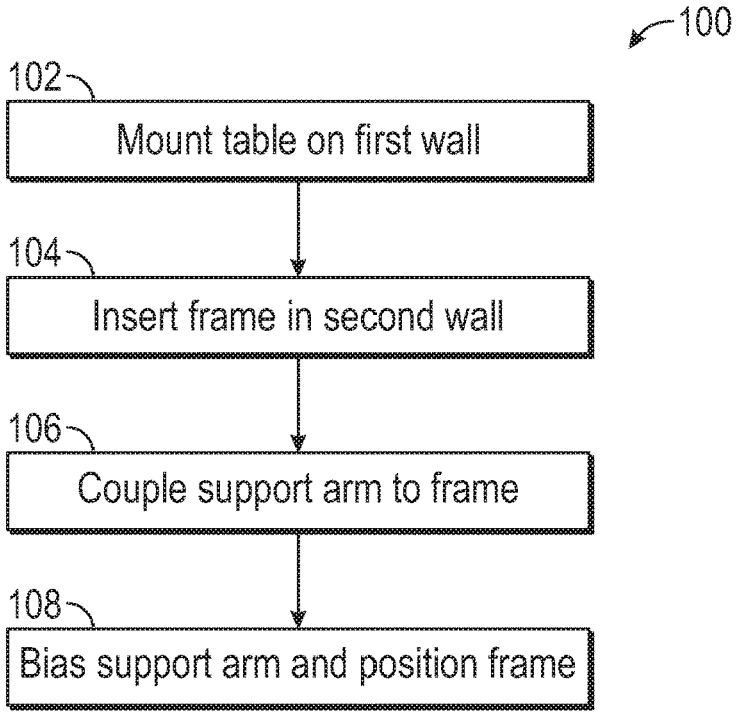
FIG. 10 is a flowchart of a method for assembling a table system having the support assembly of FIG. 1.

Referring now to FIG. 10, a flowchart of a method 100 for assembling the table system 12 having the support assembly 10 described above, with respect to FIGS. 1-9. Per block 102 of FIG. 10, the method 100 includes mounting an edge 21 (see FIG. 4) of the table 14 on a first wall 20 such that the table 14 is moveable between the stowed position 54 and the deployed position 56.

Per block 104 of FIG. 10, the frame 26 is at least partially inserted in the cavity 30 defined in the second wall 32, as shown in FIG. 3. Per block 106 of FIG. 10, the method 100 includes coupling the support arm 16 to the frame 26 such that the support arm 16 is movable through a plurality of positions between a retracted position 34 and an extended position 36. It is to be understood that the order of steps may be changed and that some steps may be omitted.

Coupling the support arm 16 to the frame 26 may include positioning the support arm 16 relative to the frame 26 such that a base surface 92 of the support arm 16 defines a reference angle 94 with respect to a reference plane 96 substantially orthogonal to the second wall 32. The method 100 may include positioning the support arm 16 such that the reference angle 94 is 0° when the support arm 16 is in the extended position 36 and the reference angle 94 is greater than 45° when the support arm 16 is in the retracted position 34.

Coupling the support arm 16 to the frame 26 may further include threading a keyed shaft 68 through respective holes 74 in a plurality of sidewalls 72 in the frame 26 and mating the keyed shaft 68 with a keyed bore 70 in the support arm 16. Coupling the support arm 16 to the frame 26 may further include positioning a seated portion of the support arm 16 in a second recessed portion 84 of the frame 26. The frame 26 includes a first recessed portion 83 having a first depth d1 and a second recessed portion 84 having a second depth d2 different from the first depth d1. The method 100 may include coupling the frame 26 to the second wall 32 by positioning at least one fastener 87 in at least one aperture 86 in the first recessed portion 83.

Per block 108 of FIG. 10, the method 100 includes biasing the support arm 16 in the retracted position 34, via a biasing member 60 operatively connected to the frame 26. Biasing the support arm 16 may further include coupling the keyed shaft 68 to the biasing member 60 to enable movement of the support arm 16 through the plurality of positions and biasing of the support arm 16 in the retracted position 34. Also per block 108 of FIG. 10, the frame 26 is positioned relative to the table 14 such that the support arm 16 moves from the retracted position 34 to the extended position via the first table surface 42 contacting a first arched surface 58A of the support arm 16 as the table 14 moves from the stowed position 54 to the deployed position 56.

In summary, a support assembly 10 is presented for a table 14 being mounted on a first wall 20, the table 14 being movable between a stowed position 54 and a deployed position 56. The support assembly 10 includes a frame 26 configured to be inserted in a cavity 30 defined in a second wall 32. At least one support arm 16 ("at least one" omitted henceforth) is rotatably coupled to the frame 26 and movable through a plurality of positions between a retracted position 34 and an extended position 36. A biasing member 60 is operatively connected to the frame 26 and configured to bias the support arm 16 in the retracted position 34, wherein the support arm 16 is configured to move from the retracted position 34 to the extended position 36 as the table 14 moves from the stowed position 54 to the deployed position 56.

The support assembly 10 may include a keyed shaft 68 operatively connected to the biasing member 60, with the support arm 16 including a keyed bore 70 configured to mate with the keyed shaft 68. The frame 26 includes a plurality of sidewalls 72 having respective holes 74. The keyed shaft 68 is threaded through the respective holes 74 and the keyed bore 70 to support the plurality of positions of the support arm 16. A bearing 76 may be positioned in at least one of the respective holes 74 and the keyed bore 70.

The second wall 32 has an outer surface 78 facing a user 24 of the table 14. The biasing member 60 may be positioned behind the outer surface 78 of the second wall 32. The support arm 16 includes a curved surface 58 configured to intersect a first table surface 42 of the table 14 as the table 14 moves in a first direction D1 from a stowed position 54 towards a deployed position 56. The curved surface 58 includes a first arched surface 58A and a second arched surface 58B. The second arched surface 58B includes a respective curvature opposed to the first arched surface 58A.

The support arm 16 includes an inclined surface 98 configured to allow the support arm 16 to be pushed towards the extended position 36 as the table 14 moves towards the deployed position 56. The support arm 16 includes a base surface 92 defining a reference angle 94 with respect to a reference plane 96, the reference plane 96 being substantially orthogonal to the second wall 32. The reference angle 94 is 0° when the support arm 16 is in the extended position 36 and the reference angle 94 is greater than 45° when the support arm 16 is in the retracted position 34.

A portion 90 of the support arm 16 may protrude from the frame 26 when the support arm 16 is in the retracted position 34. The frame 26 may include a recessed portion 82 divided into a first recessed portion 83 and a second recessed portion 84. The first recessed portion 83 has a first depth d1 and the second recessed portion 84 has a second depth d2, the first depth d1 being different from the second depth d2. The support arm 16 is at least partially positioned in the second recessed portion 84. The first recessed portion 83 includes at least one aperture 86 for coupling the frame 26 to the second wall 32. The frame 26 includes a shelf portion 88 contiguous with and positioned between the first recessed portion 83 and the second recessed portion 84. The shelf portion 88 is angled and configured to at least partially transfer a load from the support arm 16 to the frame 26.

A table system 12 includes a table 14 configured to be mounted on a first wall 20 and a support assembly 10 for supporting the table 14. The table 14 has a first table surface 42 and is moveable between a stowed position 54 and a deployed position 56. The support assembly 10 includes a support arm 16 and a frame 26 configured to be inserted in a cavity 30 in a second wall 32. The support arm 16 is rotatably coupled to the frame 26. The support arm 16 is movable through a plurality of positions between a retracted position 34 and an extended position 36 and includes a curved surface 58. A biasing member 60 is operatively connected to the frame 26 and configured to bias the support arm 16 in the retracted position 34. The support arm 16 is configured to move from the retracted position 34 to the extended position 36 via the first table surface 42 contacting the curved surface 58 of the support arm 16 as the table 14 moves from the stowed position 54 to the deployed position 56.

The support arm 16 is configured to automatically retract from the extended position 36 to the retracted position 34 when the table 14 moves from the deployed position 56 56 to the stowed position 54. The second wall 32 has an outer surface 78 facing a user 24 of the table system 12. The biasing member 60 is positioned behind the outer surface 78 of the second wall 32.

The detailed description and the drawings or FIGS. are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

What is claimed is:

1. A support assembly for a table configured to be mounted on a first wall and movable between a stowed position and a deployed position, the support assembly comprising:

a frame configured to be at least partially inserted in a cavity, the cavity being defined in a second wall, the second wall being substantially perpendicular to the first wall;

at least one support arm rotatably coupled to the frame and movable through a plurality of positions between a retracted position and an extended position; and a biasing member operatively connected to the frame and configured to bias the at least one support arm toward the retracted position, wherein the at least one support arm is configured to move from the retracted position to the extended position as the table moves from the stowed position to the deployed position.

2. The support assembly of claim 1, further comprising:

a keyed shaft operatively connected to the biasing member, wherein the at least one support arm includes a keyed bore configured to mate with the keyed shaft.

3. The support assembly of claim 2, wherein:

the frame includes a plurality of sidewalls having respective holes; and the keyed shaft is threaded through the respective holes and the keyed bore to support the plurality of positions of the at least one support arm.

4. The support assembly of claim 3, further comprising:

a bearing positioned in at least one of the respective holes and the keyed bore.

5. The support assembly of claim 1, wherein:

the second wall has an outer surface facing a user of the table; and the biasing member is positioned behind the outer surface of the second wall.

6. The support assembly of claim 1, wherein:

the at least one support arm includes a curved surface configured to intersect a first table surface of the table as the table moves in a first direction from the stowed position towards the deployed position.

7. The support assembly of claim 6, wherein:

the curved surface includes a first arched surface and a second arched surface; and the second arched surface includes a respective curvature opposed to the first arched surface.

8. The support assembly of claim 6, wherein:

the at least one support arm includes an inclined surface configured to allow the at least one support arm to be pushed towards the extended position as the table moves towards the deployed position.

9. The support assembly of claim 8, wherein:

the at least one support arm includes a base surface defining a reference angle with respect to a reference plane, the reference plane being substantially orthogonal to the second wall; and the reference angle is 0° when the at least one support arm is in the extended position and the reference angle is greater than 45° when the at least one support arm is in the retracted position.

10. The support assembly of claim 1, wherein:

a portion of the at least one support arm protrudes from the frame when the at least one support arm is in the retracted position.

11. The support assembly of claim 1, wherein:

the frame includes a recessed portion divided into a first recessed portion and a second recessed portion; and the first recessed portion has a first depth and the second recessed portion has a second depth, the first depth being different from the second depth.

12. The support assembly of claim 11, wherein:

the at least one support arm is at least partially positioned in the second recessed portion; and the first recessed portion includes at least one aperture for coupling the frame to the second wall.

13. The support assembly of claim 11, wherein:

the frame includes a shelf portion contiguous with and positioned between the first recessed portion and the second recessed portion; and the shelf portion is angled and configured to at least partially transfer a load from the at least one support arm to the frame.

14. A table system comprising:

a table configured to be mounted on a first wall and moveable between a stowed position and a deployed position, the table having a first table surface; and a support assembly for supporting the table, the support assembly comprising:

at least one support arm movable through a plurality of positions between a retracted position and an extended position, the at least one support arm having a curved surface;

a frame configured to be at least partially inserted in a cavity in a second wall, the at least one support arm being rotatably coupled to the frame; and a biasing member operatively connected to the frame and configured to bias the at least one support arm toward the retracted position, wherein the at least one support arm is configured to move from the retracted position to the extended position via the first table surface contacting the curved surface of the at least one support arm as the table moves from the stowed position to the deployed position.

15. The table system of claim 14, wherein:

the at least one support arm is configured to automatically retract from the extended position to the retracted position when the table moves from the deployed position to the stowed position.

16. The table system of claim 14, wherein:

the second wall has an outer surface facing a user of the table system; and the biasing member is positioned behind the outer surface of the second wall.

17. A method for assembling a table system, the method comprising:

mounting an edge of a table on a first wall such that the table is moveable between a stowed position and a deployed position, the table having a first table surface;

inserting a frame at least partially into a cavity defined in a second wall, the second wall being substantially perpendicular to the first wall;

coupling at least one support arm to the frame such that the at least one support arm is movable through a plurality of positions between a retracted position and an extended position;

biasing the at least one support arm toward the retracted position, via a biasing member operatively connected to the frame; and positioning the frame relative to the table such that the at least one support arm moves from the retracted position to the extended position via the first table surface contacting a curved surface of the at least one support arm as the table moves from the stowed position to the deployed position.

18. The method of claim 17, wherein coupling the at least one support arm to the frame further comprises:

threading a keyed shaft through respective holes in a plurality of sidewalls in the frame; and mating the keyed shaft with a keyed bore in the at least one support arm.

19. The method of claim 18, wherein biasing the at least one support arm further comprises:

coupling the keyed shaft to the biasing member to enable movement of the at least one support arm through the plurality of positions and biasing of the at least one support arm toward the retracted position.

20. The method of claim 17, wherein coupling the at least one support arm to the frame further comprises:

positioning the at least one support arm relative to the frame such that a base surface of the at least one support arm defines a reference angle with respect to a reference plane substantially orthogonal to the first wall; and positioning the at least one support arm such that the reference angle is 0° when the at least one support arm is in the extended position and the reference angle is greater than 45° when the at least one support arm is in the retracted position.

21. The method of claim 17, wherein coupling the at least one support arm to the frame further comprises:

positioning a seated portion of the at least one support arm in a second recessed portion of the frame, the second recessed portion having a second depth and the frame including a first recessed portion having a first depth different from the second depth; and wherein the method further comprises coupling the frame to the second wall by positioning at least one fastener in at least one aperture in the first recessed portion.

* * * * *